US006077109A

United States Patent [19]

Prazoff

[11] Patent Number: 6,077,109

[45] Date of Patent: Jun. 20, 2000

[54] EXTENSION SOCKET

[76] Inventor: Michael Prazoff, 555 Chabanol St., West Ste #700, Montreal, Quebec, Canada, H2N-2J2

[21] Appl. No.: 09/246,885

[22] Filed: Feb. 8, 1999

[51] Int. Cl.[7] ..... H01R 13/72

[52] U.S. Cl. ..... 439/501; 191/12.4

[58] Field of Search ..... 439/501, 4; 191/12.4

[56] References Cited

U.S. PATENT DOCUMENTS

| | | | |
|---|---|---|---|
| 4,282,954 | 8/1981 | Hill | 191/12.4 |
| 4,520,239 | 5/1985 | Schwartz | 191/12.4 |
| 4,656,320 | 4/1987 | Maddock | 191/12.4 |
| 5,657,841 | 8/1997 | Morvan | 191/12.4 |
| 5,700,150 | 12/1997 | Morin | 439/4 |

*Primary Examiner*—Neil Abrams
*Assistant Examiner*—Hae Moon Hyeon
*Attorney, Agent, or Firm*—Raymond Y. Chan; David and Raymond

[57] ABSTRACT

An extension socket includes a socket body which consists of more than one socket units electrically connected each other, an electrical plug, an extension wire having a predetermined length connecting between the socket units of the socket body and the electrical plug, and an extension wire receiving arrangement for receiving the extension wire. The socket body includes a socket housing to install the socket units therein. The socket housing has a top wall, a bottom wall and a surrounding side wall between the top wall and the bottom wall, wherein the extension wire is extended from a wire outlet of the surrounding side wall to the electrical plug. The extension wire receiving arrangement is composed of a ring shaped protecting wall which is arranged to surround the socket housing of the socket body and has a predetermined height, and a connecting wall extended from a top end of the protecting wall to the socket housing, wherein a receiving chamber is defined between the protective wall and the surrounding side wall of the socket housing. Thereby, the extension wire can be wound around the surrounding side wall of the socket housing within the receiving chamber.

3 Claims, 3 Drawing Sheets

EXTENSION SOCKET

FIELD OF THE PRESENT INVENTION

The present invention relates to electric socket, and more particularly to an extension socket having an extension wire receiving arrangement which is adapted to store the extension wire when the extension socket is not in use or, alternatively, to merely extend a length of the extension wire equal to the distance between the extension socket and the wall socket.

BACKGROUND OF THE PRESENT INVENTION

Every electrical appliance needs electrical power source to function. Generally, electrical power can be obtained from the wall sockets by plugging thereto with an electrical plug of the electrical appliance. The problem is that although you may have a lot of electrical appliances, you have only limited number of wall sockets available at home or in the office.

Extension socket can solve the above problem and also can provide multiple socket units for more than one electrical appliances to share the power source from the same wall socket. Conventional extension socket comprises a socket body having a plurality of socket units thereon, an electrical plug for connecting to the wall socket or other extension socket, and an elongated extension wire connecting between the plurality of socket units and the electrical plug. In order to adapt different environmental needs, the extension wire normally has a length varying from several feet to more than 10 feet. The extended length of the extension wire can solve the distant problem as mentioned above, but also creates another problem in most circumstances. For example, if the electric plug of the electrical appliance is five feet away from the wall socket and a ten feet extension socket is used to connect the electrical appliance with the wall socket, there is a five feet excessive length of the extension wire unreasonably entangling on the ground.

Some manufacturers incorporate complicated and costly rewinding device in the conventional extension socket, so that the user may merely pull out the required length of extension wire for use. The rest of the extension wire is wound inside the extension socket by means of the rewinding device. However, such auto-rewinding extension socket is not popular in market because of the following reasons:

(1) The rewinding device unreasonably increases the cost of the extension device that renders such auto-rewinding extension socket being too expensive.

(2) The user must use extra pulling force to pull out the extension wire for overcoming the rewinding spring force of such auto-rewinding extension socket.

(3) The rewinding spring force also will gradually pull the electrical plug out form the wall socket.

(4) Some of the auto-rewinding extension sockets even need to employ an additional brake or locking device to prevent the pulled out extension wire from rewinding back.

Accordingly, most of the users rather let the excessive extension wire getting entangled than paying extra expense to purchase such impractical auto-rewinding extension socket.

SUMMARY OF THE PRESENT INVENTION

It is thus a first object of the present invention to provide an extension socket having an extension wire receiving arrangement adapted to store the extension wire when the extension socket is not in use or, alternatively, to merely extend a length of the extension wire equal to the distance between the extension socket and the wall socket.

A further object of the present invention is to provide an extension socket which can provide an extension wire receiving arrangement for receiving the extension wire without increasing the structural cost of the extension socket.

Accordingly, in order to accomplish the above objects, the present invention provides an extension socket which comprises a socket body which comprises more than one socket units electrically connected each other, an electrical plug, an extension wire having a predetermined length connecting between the socket units of the socket body and the electrical plug, and an extension wire receiving arrangement for receiving the extension wire. The socket body comprises a socket housing to install the socket units therein. The socket housing has a top wall, a bottom wall and a surrounding side wall between the top wall and the bottom wall, wherein the extension wire is extended from a wire outlet of the surrounding side wall to the electrical plug. The extension wire receiving arrangement comprises a ring shaped protecting wall which is arranged to surround the socket housing of the socket body and has a predetermined height, and a connecting wall extended from a top end of the protecting wall to the socket housing, wherein a receiving chamber is defined between the protective wall and the surrounding side wall of the socket housing. Thereby, the extension wire can be wound around the surrounding sidewall of the socket housing within the receiving chamber.

DETAILED DESCRIPTION OF THE PREFERRED EMBODIMENT

Figure 1:
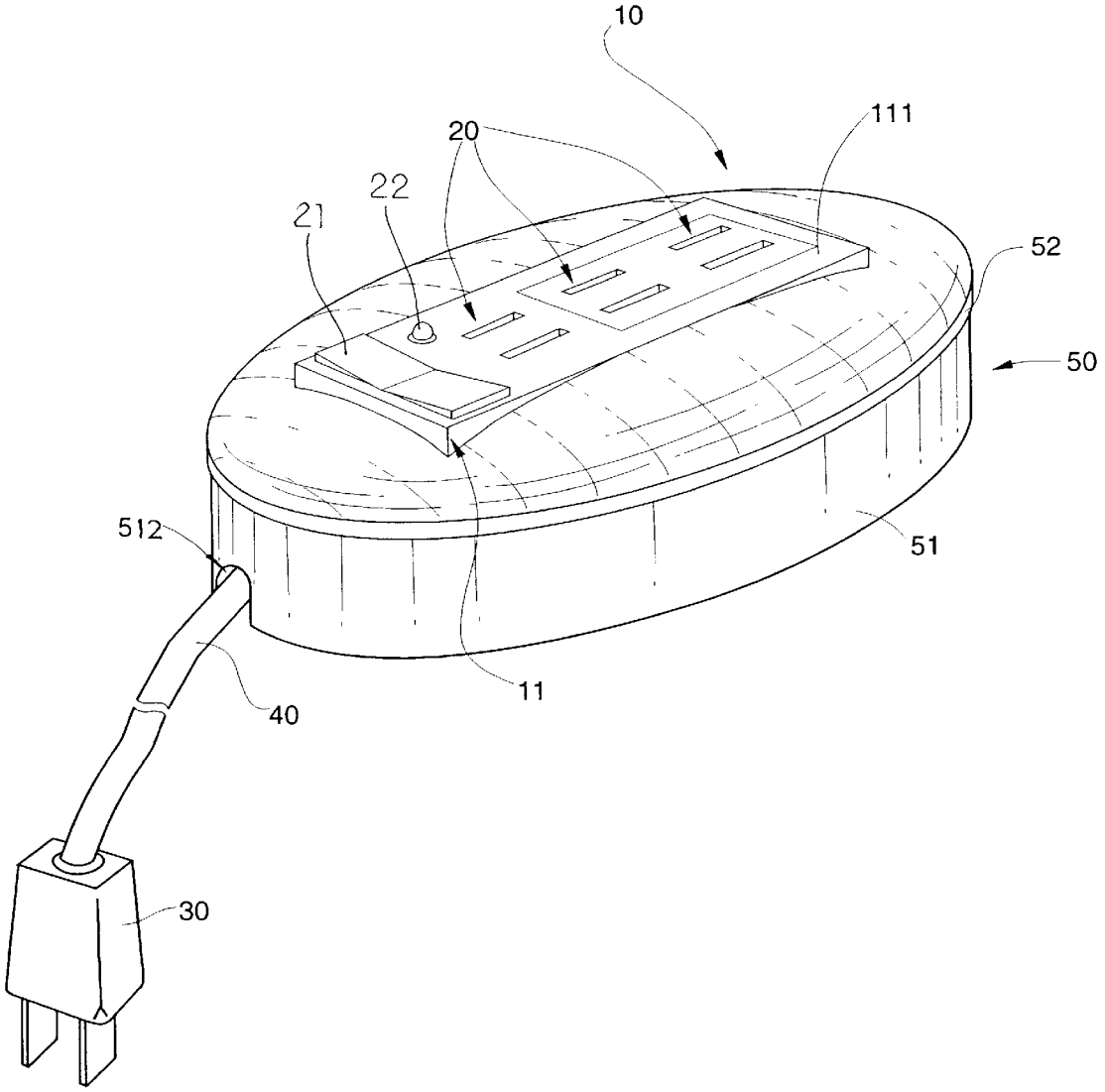
FIG. 1 is a top perspective view of an extension socket according to a preferred embodiment of the present invention.
Figure 2:
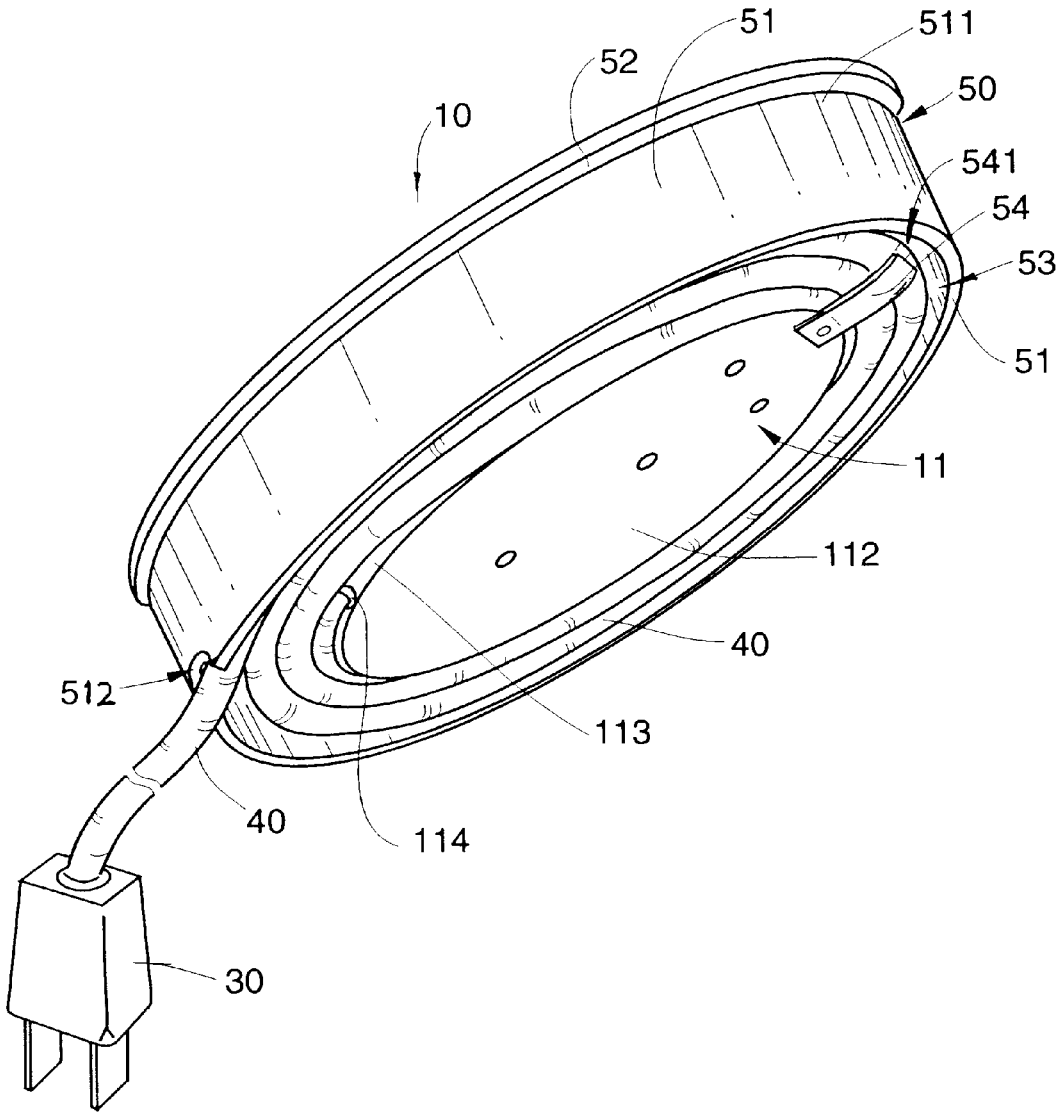
FIG. 2 is a bottom perspective view of the extension socket according to the above preferred embodiment of the present invention.
Figure 3:
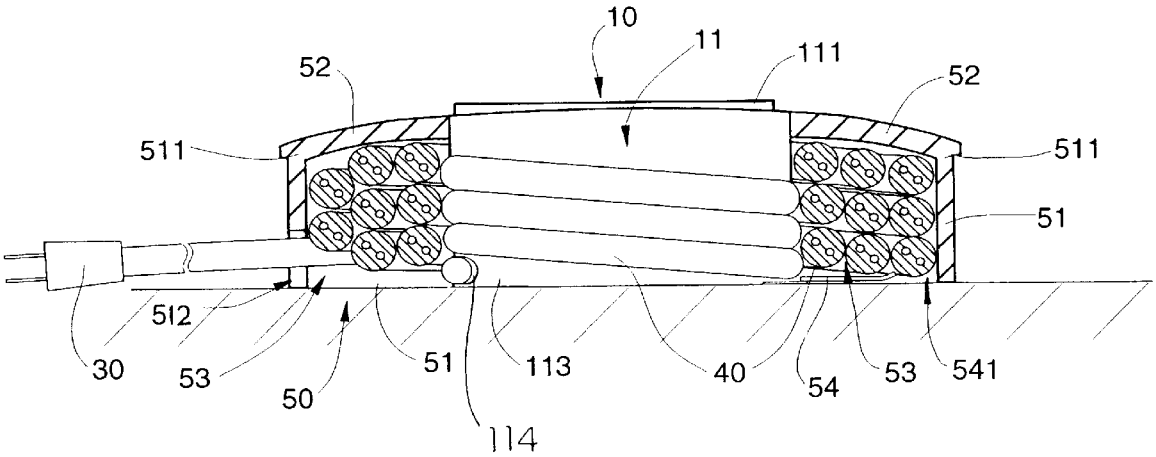
FIG. 3 is a partially sectional view of the extension socket according to the above preferred embodiment of the present invention.

Referring to FIGS. 1 to 3, an extension socket according to a preferred embodiment of the present invention is illustrated. The extension socket comprises a socket body 10 which comprises more than one socket units 20 electrically connected each other, an electrical plug 30, an extension wire 40 having a predetermined length connecting between the socket body 10 and the electrical plug 30, and an extension wire receiving arrangement 50 for receiving the extension wire 40.

The socket body 10 comprises a socket housing 11 to install the socket units 20 therein. An electrical breaker switch 21 and a power indicating light 22 are installed on the socket body 10, as shown in FIG. 1. The socket housing 11 has a top wall 111, a bottom wall 112 and a surrounding side wall 113 between the top wall 111 and the bottom wall 112, wherein the extension wire 40 is extended from a wire outlet 114 of the surrounding side wall 113 to the electrical plug 30, as shown in FIG. 2.

As shown in FIG. 1, when the power supply is normal, the power indicating light 22 is lighted on. However, when the extension socket is malfunctioned, the power indicating light 22 will not light on so that the user may notice that the extension socket is out of order. Moreover, the electrical breaker switch 21 such as the U.S. Pat. No. 5,262,748 will switch off the power supply of the extension socket of the present invention if the electrical appliance(s) connected thereto is overheated or electrically shocked.

The extension wire receiving arrangement 50 comprises a ring shaped protecting wall 51 which is arranged to surround the socket housing 11 of the socket body 10 and has a predetermined height. The extension wire receiving arrangement 50 further comprises a connecting wall 52 extended between a top end 511 of the protecting wall 51 to the socket housing 11, wherein a receiving chamber 53 is defined between the protective wall 51 and the surrounding side wall 113 of the socket housing 11, so that the whole length of the extension wire 40 is able to be received inside the receiving chamber 53 by winding around the surrounding side wall 113 of the socket housing 11.

According to the preferred embodiment, the bottom wall 112 of the socket housing 11 is detachably mounted onto the surrounding side wall 113 for facilitating the installation of the socket units 20. In order to minimize the structural cost and simplify the manufacturing steps of the extension socket of the present invention, the protecting wall 51, the connecting wall 52 and the top wall 111 and the surrounding side wall 113 of the socket housing 11 are made in one body structure, so that they can be made by a single plastic mould through a single injection step. It saves both the manufacturing time and molding cost. As shown in FIGS. 1 and 3, the connecting wall 52 is integrally extended outwardly from an outer circumference of the top wall 111 of the socket housing 11, so that the receiving room of the receiving chamber 53 can be maximized. Structurally speaking, as shown in FIG. 1, the top wall 111 of the socket housing 11 and the connecting wall 52 of the extension wire receiving arrangement 50 are made of an enlarged continuous wall, so that the entire extension socket of the present invention looks like a conventional extension socket.

As shown in FIGS. 2 and 3, when the extension socket is not in use, the extension wire 40 can be organized to store inside the receiving chamber 53 by winding around the surrounding side wall 113 of the socket housing 11 of the socket body 10. Therefore, it is more easily to store the extension socket of the present invention because no extension wire 40 will be entangled around the socket body as happened in the conventional extension socket. Moreover, since the extension wire 40 can be overlappedly wound within the receiving chamber 53, a relatively small receiving room is capable of receiving a long length of the extension wire 40.

The surrounding side wall 113 is preferred to be made in round shape, such as elliptical or circular shape, to avoid corner bending. According to the preferred embodiment of the present invention, the surrounding side wall 113 of the socket housing 11 is made in elliptical shape, so as to facilitate the extension wire 40 to wind therearound. The protective wall 51 of the extension wire receiving arrangement 50 is also made in elliptical shape but having a larger size than the surrounding side wall 113 in order to avoid a waste of receiving room, so that the entire receiving chamber 53 can be filled with extension wire 40 and the size of the extension socket of the present invention can thus be minimized.

A wire outlet slot 512 is formed on the protective wall 51 to enable the extension wire to extend therethrough. The wire outlet slot 512 is made in U-shaped, extending upwardly from a bottom end of the protecting wall 51. The wire outlet slot 512 is preferred to be positioned at the same side of the wire outlet 114 provided on the surrounding side wall 113, so that when the extension wire is needed to fully extend, the extension wire 40 can be extended directly from the wire outlet 114 to the wire outlet slot 512 with a shortest length.

When the distance between the electric plug of an electrical appliance and the wall socket is measured and determined, the user may simply unwind a respective length of the extension wire 40 to extend out from the receiving chamber 53. The rest of the extension wire can be kept storing inside the receiving chamber 53 to avoid the extension wire from getting entangled. Besides, when the extension socket of the present invention is set on the ground or hanged on a wall with the receiving chamber 53 facing towards the ground or the wall, as shown in FIG. 3, no one can see the non-used extension wire 40 from outside because it is sheltered and protected by the protecting wall 51 and the connecting wall 52 of the extension wire receiving arrangement 50.

As shown in FIGS. 2 and 3, the extension wire receiving arrangement 50 can further comprise a holding arm 54 which is made of elastic material. T arm 54 has one end affixed to the bottom wall 112 of the socket housing 11 while another end extending outwards across the receiving chamber 53. The length of the holding arm 54 should be smaller than a width of the receiving chamber 53, i.e. the distance between the surrounding side wall 113 and the protecting wall 51, so as to define an inlet gap 541 having a width equal to or slightly smaller than a cross sectional size of the extension wire 40. Therefore, the extension wire 40 can enter the receiving chamber 53 via the inlet gap 541 and the rounds of extension wire 40 stored inside the receiving chamber 53 is restricted by the holding arm 54 to prevent dropping out.

What is claimed is:

1. An extension socket, comprising:

a socket body comprising more than one socket units electrically connected each other, wherein said socket body further comprises a socket housing to install said socket units therein, said socket housing having a top wall, a bottom wall and a surrounding side wall between said top wall and said bottom wall, said surrounding side wall having a wire outlet provided thereon;

an electrical plug;

an extension wire having a predetermined length connecting between said socket body and said electrical plug, wherein said extension wire is extended from said wire outlet of said surrounding side wall to said electrical plug; and an extension wire receiving arrangement for receiving said extension wire, which comprises a protecting wall which has a predetermined height arranged to surround said socket housing of said socket body, and a connecting wall extended between a top end of said protecting wall to said socket housing, wherein a receiving chamber is defined between said protective wall and said surrounding side wall of said socket housing, so that said extension wire is able to be entirely received inside said receiving chamber by winding around said surrounding side wall of said socket housing, wherein said extension wire receiving arrangement further comprises a holding arm made of elastic material, said holding arm having one end connected to said bottom wall of said socket housing while another end extending outwards across said receiving chamber, said holding arm having a length smaller than a width of said receiving chamber so as to define an inlet gap to let said extension wire entering said receiving chamber via said inlet gap, so that said extension wire stored inside said receiving chamber is restricted by said holding arm to prevent dropping out.

2. An extension socket, comprising:

a socket body comprising more than one socket units electrically connected each other, wherein said socket body further comprises a socket housing to install said socket units therein, said socket housing having a top wall, a bottom wall and a surrounding side wall between said top wall and said bottom wall, said surrounding side wall having a wire outlet provided thereon;

an electrical plug;

an extension wire having a predetermined length connecting between said socket body and said electrical plug, wherein said extension wire is extended from said wire outlet of said surrounding side wall to said electrical plug; and an extension wire receiving arrangement for receiving said extension wire, which comprises a protecting wall which has a predetermined height arranged to surround said socket housing of said socket body, and a connecting wall extended between a top end of said protecting wall to said socket housing, wherein a receiving chamber is defined between said protective wall and said surrounding side wall of said socket housing, thereby said extension wire is able to be entirely received inside said receiving chamber by winding around said surrounding side wall of said socket housing;

wherein said protecting wall, said connecting wall and said top wall and said surrounding side wall of said socket housing are integrally made in one body structure and said connecting wall is integrally extended outwardly from an outer circumference of said top wall of said socket housing;

wherein said surrounding side wall of said socket housing is made in elliptical shape and said protective wall of said extension wire receiving arrangement is also made in elliptical shape but having a larger size than said surrounding side wall;

wherein a wire outlet slot is formed on said protective wall to enable said extension wire to extend therethrough, said wire outlet slot being made in U-shaped and extended upwardly from a bottom end of said protecting wall and said wire outlet slot being positioned at the same side of said wire outlet provided on said surrounding side wall;

wherein said extension wire receiving arrangement further comprises a holding arm made of elastic material, said holding arm having one end connected to said bottom wall of said socket housing while another end extending outwards across said receiving chamber, said holding arm having a length smaller than a width of said receiving chamber so as to define an inlet gap to let said extension wire entering said receiving chamber via said inlet gap, so that said extension wire stored inside said receiving chamber is restricted by said holding arm to prevent dropping out.

3. An extension socket, as recited in claim 2, further comprising an electrical breaker switch and a power indicating light installed on said socket body, wherein said power indicating light remains lighted on when the power supply is normal, and that said electrical breaker switch automatically switches off the power supply of said extension socket when an electrical appliance connected thereto is overheated or electrically shocked.

* * * * *